United States Patent [19]

Litowitz

[11] Patent Number: 4,713,993

[45] Date of Patent: Dec. 22, 1987

[54] TABLE SAW GUIDE CONSTRUCTION

[76] Inventor: Robert H. Litowitz, Old Pump House, Harriman Rd., Irvington, N.Y. 10533

[21] Appl. No.: 893,868

[22] Filed: Aug. 6, 1986

[51] Int. Cl.[4] ..... B26D 1/00; B26D 3/00; B26D 7/06

[52] U.S. Cl. ..... 83/34; 83/438; 83/447; 83/477.2

[58] Field of Search ..... 83/438, 471, 477, 477.2, 83/441, 447, 450, 34

[56] References Cited

U.S. PATENT DOCUMENTS 326,454 9/1885 Rawlings ..... 83/438

1,938,548 12/1933 Tantz ..... 83/438

*Primary Examiner*—Paul A. Bell

*Assistant Examiner*—Scott A. Smith

*Attorney, Agent, or Firm*—Charles E. Temko

[57] ABSTRACT

A table saw guide or fence for maintaining a workpiece in position parallel to the plane of a saw blade, in which the guiding edge is capable of initial adjustment in direct contact with a planar surface of the blade, and is maintained in such condition until a parallelogram linkage is secured to the saw table, following which the guiding edge may be released and moved over the surface of the saw table without loss of parallel relation relative to the saw blade, and selectively fixed in position at a location corresponding to the desired width of the cut workpiece.

3 Claims, 7 Drawing Figures

FIG. 1.
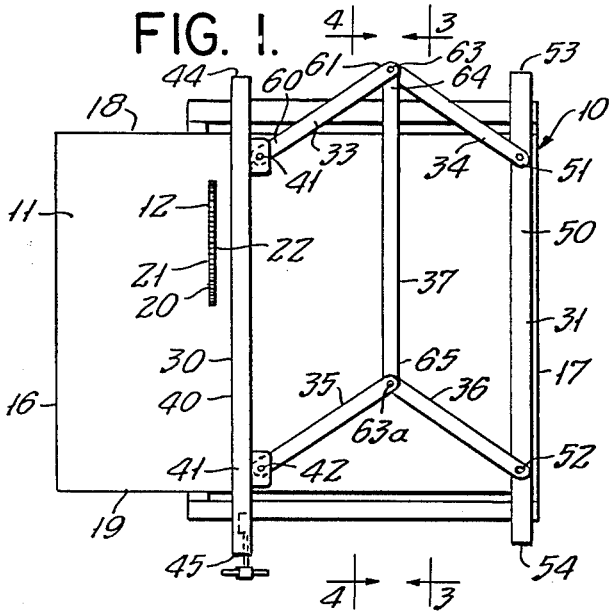
FIG. 2.
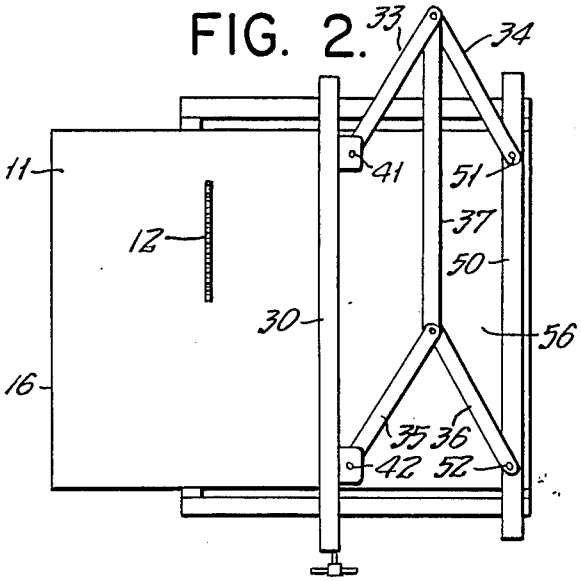
FIG. 3.
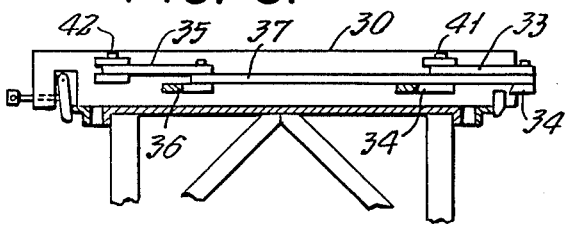
FIG. 4.
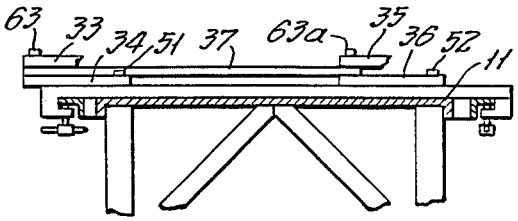
FIG. 6.
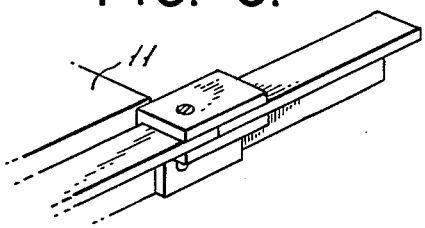
FIG. 5.
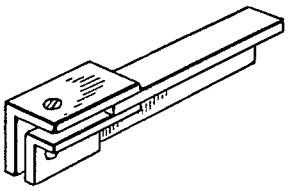
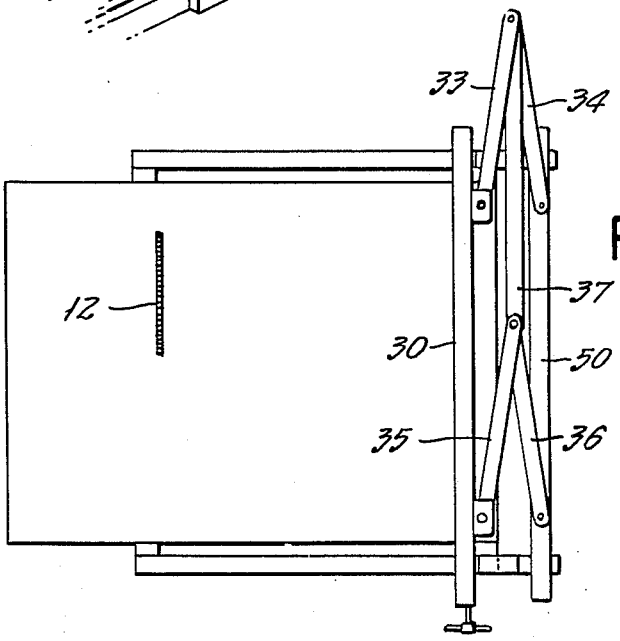
FIG. 7.

TABLE SAW GUIDE CONSTRUCTION

BACKGROUND OF THE INVENTION

This invention relates generally to the field of power-driven table saws including an arbor-mounted circular blade, or a flexible saw band which passes through an opening in the saw table which supports a workpiece. Devices of this general type are known in the art, and the invention lies in specific details of construction which provide improved accuracy with regard to maintaining a given adjustment, as well as improved ease in use.

When sawing wood, for example, it is normally very important to move the wood through the blade so that the axis of movement remains parallel to the plane of the saw blade at all times during the sawing operation. This insures that the blade will provide a good clean cut so that the cut wood surface will be smooth, requiring a minimum of sanding. The wood is guided by having its edge pressed against a guide or fence, the surface of which is parallel to the plane of the saw blade and set at a distance from the saw blade which will yield a cut workpiece of desired width.

As the means of holding the workpiece, conventional saw guides are clamped by various means to a fixed bar along the front edge of the saw table. This bar must be mounted so that it is exactly perpendicular to the plane of the saw blade. The movable fence is clamped to this bar by means of brackets, the design of which may vary, which are perpendicular to the axis of the fence. Such arrangements have several critical failings. Most importantly, the fixed bar must be exactly perpendicular to the saw blade. This is not always the case for a variety of reasons. The bar itself may not have been perfectly mounted. The bar may have shifted in position slightly over a period of time. The saw arbor may have shifted slightly so that it (and thus the blade) are no longer perpendicular to the bar.

Thus, the fence systems now in use which rely on this arrangement are all severely flawed in operation. In order for the fence to move in relation to the bar, there must be a bit of "play" between the fence bracket and the bar. At best, the fence is parallel to the saw blade only when it is clamped in position, a fact which makes adjustment and proper positioning of the fence quite difficult. In addition, there are often problems involved in simply sliding the fence along the guide bar to get it into the desired position. It frequently binds, and must be forced along the guide bar, thereby compounding the problems of parallel alignment abovementioned.

SUMMARY OF THE INVENTION

Briefly stated, the invention contemplates an improved construction in which the abovementioned disadvantages have been substantially eliminated. My invention relies upon the parallelogram as a means of ensuring that the saw fence is always parallel to the plane of the saw blade. Two contiguous interconnected parallelograms are used so that the guiding surface of the saw fence always remains at the same distance relative to the front edge of the saw table. My saw fence is different from those in common use in that it is aligned by reference to the saw blade itself, rather than to a permanently fixed bar or surface.

BRIEF DESCRIPTION OF THE DRAWING

In the drawing, to which reference will be made in the specification, similar reference characters have beem employed to designate corresponding parts throughout the several views.

FIG. 1 is a schematic top plan view of an embodiment of the invention.

FIG. 2 is a similar schematic top plan view thereof, showing certain of the component parts in altered relative position.

FIG. 3 is a fragmentary transverse sectional view as seen from the plane 3—3 in FIG. 1.

FIG. 4 is a fragmentary transverse sectional view as seen from the plane 4—4 in FIG. 1.

FIG. 5 is a perspective view of an extension rail element forming a part of the disclosed embodiment.

FIG. 6 is a fragmentary perspective view showing the structure of FIG. 5 in installed condition upon the structure of FIG. 2.

FIG. 7 is a top plan view corresponding to that seen in FIG. 2 with the guide in one outer limit of the path of adjustment.

DETAILED DESCRIPTION OF THE DISCLOSED EMBODIMENT

In accordance with the invention, the device, generally indicated by reference character 10, is illustrated in the drawings in position upon a conventional saw table 11, having a circular blade 12 carried by an arbor (not shown) driven by an electric motor or other source of motive power. The table is arranged in a horizontal plane, and is bounded by a pair of longitudinal edges 16 and 17, and a pair of transversed edges 18 and 19, one of which may be considered a front edge of the table.

The blade 12 may be of any known type, and is bounded by a peripheral tooth cutting edge 20, and first and second parallel side surfaces 21 and 22.

The device 10 is capable of complete disengagement with respect to the table 11 and comprises in essence a pair of linked parallelograms. These are formed by an elongated guide bar 30, a fixed guide bar 31, the bars 30 and 31 being interconnected by a movable linkage means including first, second, third and fourth elongated links, 33, 34, 35, and 36; which are maintained in mutually parallel condition by a centrally positioned elongated bar 37. The members 32–36 may be most conveniently formed as metallic stampings. The bars 30 and 31, and the bar 37 are preferably formed of metal extrusion or other rigid material.

The bar 30 includes an outwardly disposed guiding surface 40 against which a workpiece (not shown) is pressed during a cutting operation. An upper surface 41 mounts first and second pin joints 42 and 43 at locations medially of first and second ends 44 and 45. It will be observed that the overall length of the bar 30 is somewhat greater than the distance between the transversed edges 18 and 19 of the table 11 to permit convenient clamping once an adjusted position has been obtained.

The guide bar 31 includes an upper surface 50, mounting first and second joint pins 51 and 52 positioned inwardly of first and second ends 53 and 54. A lower surface (not shown) is adapted to rest upon the upper surface 56 of the table 11, and is secured in desired position by clamps 57 and 58 in well known manner.

The links 33–36 are of similar dimension, each including a first or outer end 60 having an opening engaging a corresponding pin joint on either the bar 30 or the bar 31. A second end 61 is also provided with a similar orifice which engages pin joints 63 and 63*a* which are located between first and second ends 64 and 65 on the bar 37. From a comparison of FIGS. 1 and 2, it will be apparent that when either the bar 30 or the bar 31 is in fixed position relative to the table 11, the other bar may be moved parallel thereto over the surface of the table. Because of the use of a double parallelogram, rather than a single one, the unfixed bar, during such movement, may be maintained parallel over the table, rather than to one side of the same.

OPERATION

Adjustment of the device will be apparent from a comparison between FIGS. 1 and 2 in the drawing. To begin, the bar 30 is first placed against the saw blade 12, and thus the left side of the leftward parallelogram is maintained temporarily against the surface of the blade by a clamp 71. The device is then extended so that the bar 31 is as close to the right hand edge of the saw table 11 (viewed facing into the saw blade) as desired. The bar 31 is then fixedly clamped to the saw table using clamps 57–58. The clamp 71, temporarily holding the bar 30 against the saw blade is now released, and the bar is moved to a position which allows for the desired width of cut of the workpiece. The bar 30 is then clamped in desired position by clamp 71, following which the sawing operation may commence.

It will be apparent that my inventive structure has several advantages over conventional saw fence constructions. It is adjusted with reference to the saw blade itself, and thus is accurate, irrespective of possible shifts in the axis of the saw arbor or front edge of the saw table or guide bar. Because the device is self contained, it moves easily into desired positions, and does not have to be forced to slide along a guide bar as is the case with conventional systems. Most importantly, my guide bar or fence is always parallel to the plane of the saw blade, and does not shift when locked into place as is the case with conventional systems.

FIGS. 5, 6 and 7 illustrate the use of a pair of extension elements 70 having socket forming means 71 at one end thereof engageable with corresponding ends 72 on the table 11, in turn supporting rails 73 capable of adjustably supporting the bar 31 using the clamps 57–58. The extensions 70 are employed where a width of cut is desired which is equal to or greater than the length of the table as measured rightwardly of the blade 12 as seen in FIG. 2.

As seen in FIG. 7, even when widths of this dimension are made, the pivotally interconnected linkage comprising the bars 30 and 31 need not be totally collapsed, thus making it easier to maintain the rigidity of a given adjustment.

I wish it to be understood that I do not consider the invention limited to the precise details of structure shown and set forth in the specifications as obvious modifications will occur to those skilled in the art to which the invention pertains.

I claim:

1. An improved guide construction for power driven table saws having a cutting blade moving in a given plane, and a generally horizontally positioned table having an outwardly facing surface perpendicular to the plane of said cutting blade, said construction comprising: first and second elongated guide bars, a pivotally interconnected linkage interconnecting said first and second guide bars for maintaining said bars in mutually parallel relatively movable relation, said linkage including a third centrally disposed elongated bar, and at least four links pivotally interconnected to points on said third bar and one of said first and second guide bars to form a pair of parallelograms; clamping means for selectively clamping an outwardly facing surface of said first guide bar against a planar surface of said cutting blade, clamping means for selectively clamping said second guide bar to said table; and clamping means for selectively clamping said first guide bar to said table; whereby said construction is positioned for guiding a workpiece by first engaging said first member against said blade, moving said second guide bar to desired position on said table, clamping said second guide bar to said table, releasing said first guide bar from engagement against said blade, relocating said first guide bar to appropriate guiding location; and clamping said first guide bar at said last mentioned location to said table.

2. The method of locating a saw table guide for positioning a workpiece is sliding relation parallel to the plane of a cutting blade comprising the steps of:

providing a saw table guide having first and second elongated members, each having a principal axis, interconnected for relative movement in a plane such that the principal axes remain in mutually parallel relation;

clamping a planar surface of said first elongated member in abutting relation to a side surface of said cutting blade;

moving said second elongated member to a desired location on a surface of a saw table;

clamping said second elongated member to said table;

releasing said first elongated member from said cutting blade and locating said first elongated member a distance from said blade in accordance with the cut width of a workpiece; and clamping said first elongated member to said table at said location.

3. Improved guide construction in accordance with claim 1, further characterized in the provision of an auxiliary table extending element of generally rectangular configuration and having means for clamping the same in parallel relation relative to the plane of said table to extend laterally of said table from an edge thereof; said second elongated guide bar being fixed to said element to permit said first elongated bar to be positioned in the area of said last-mentioned edge without the need for totally collapsing said pivotally interconnected linkage.

* * * * *